US008678307B2

(12) United States Patent
Rittler

(10) Patent No.: US 8,678,307 B2
(45) Date of Patent: Mar. 25, 2014

(54) HEAVY-DUTY DRIVE ARRANGEMENT AND MILL DRIVEN BY THE SAME

(75) Inventor: Stefan Rittler, Freienstein (CH)

(73) Assignee: FLSmidth A/S, Valby (DK)

( * ) Notice: Subject to any disclaimer, the term of this patent is extended or adjusted under 35 U.S.C. 154(b) by 477 days.

(21) Appl. No.: 13/060,103

(22) PCT Filed: Aug. 22, 2008

(86) PCT No.: PCT/EP2008/060991

§ 371 (c)(1),
(2), (4) Date: Feb. 22, 2011

(87) PCT Pub. No.: WO2010/020287

PCT Pub. Date: Feb. 25, 2010

(65) Prior Publication Data

US 2011/0147508 A1 Jun. 23, 2011

(51) Int. Cl.
*B02C 15/00* (2006.01)

(52) U.S. Cl.
USPC ..... 241/101.2; 241/117

(58) Field of Classification Search
USPC ..... 241/101.2, 117–121
See application file for complete search history.

(56) References Cited

U.S. PATENT DOCUMENTS

| | | | |
|---|---|---|---|
| 4,572,442 | A | 2/1986 | Sigg |
| 4,887,489 | A | 12/1989 | Sigg |

FOREIGN PATENT DOCUMENTS

| | | | |
|---|---|---|---|
| BE | 809236 | A7 | 4/1974 |
| CH | 658801 | A5 | 12/1986 |
| DE | 10305915 | A1 | 8/2004 |
| WO | 2008031694 | A | 3/2008 |

OTHER PUBLICATIONS

International Search Report of PCT/EP08/060991 dated May 25, 2009.

*Primary Examiner* — Mark Rosenbaum
(74) *Attorney, Agent, or Firm* — Buchanan Ingersoll & Rooney PC

(57) ABSTRACT

A heavy-duty drive arrangement for a mill having a grinding bowl ratable about a vertical axis comprises a housing, an electric motor, and a gearing arrangement disposed in the housing and supported on the housing. The grinding bowl can be driven by means of the electric motor via the gearing arrangement. The electric motor is disposed below the gearing arrangement. The electric motor is integrated in the housing. Advantageously, the electric motor is supported on the housing particularly on a bottom element of the housing. The rotor can be connected directly, or via a coupling integrated in the rotor, to a gear of the gearing arrangement. The mill may be, for example, a roller bowl mill.

20 Claims, 4 Drawing Sheets

HEAVY-DUTY DRIVE ARRANGEMENT AND MILL DRIVEN BY THE SAME

CROSS-REFERENCE TO RELATED APPLICATIONS

This application is the United States national stage under 35 U.S.C. §371 of International Application No. PCT/EP2008/060991, filed on Aug. 22, 2008. The entirety of this application is incorporated by reference herein.

FIELD OF THE INVENTION

The invention relates to mills, such as roller bowl mills, particularly cement mills and coal mills, as well as particularly to heavy-duty drive arrangements used therefore.

BACKGROUND OF THE INVENTION

In most of the present-day cement mills and coal mills, the roller bowl is driven via a gearing by a motor disposed laterally adjacent the gearing. In the case of such mills having a horizontally disposed roller bowl, the rotary motion of the motor is transmitted via a coupling to a bevel gear step, through which the rotary motion being initially about a horizontal axis is redirected to a vertical axis. In most cases a planetary gearing is used as the gearing, which moves the roller bowl via an output flange; alternatively or additionally, use is often made of a spur gearing, too.

For example, FIG. 1 of Swiss Patent No. 658 801 discloses a structure of this kind.

Manufacturing bevel gear steps is very expensive, in particular if they are to have great precision. Moreover, bevel gear steps generate very large radial and axial forces in the bearings which are to be absorbed, resulting in correspondingly extensive dimensioning.

U.S. Pat. No. 4,887,489 proposes to place the motor with vertical axis laterally adjacent the gearing and to transmit the rotary motion by means of a cascade of gears into the gearing, since in this way no bevel gearing is required.

FIGS. 2 to 4 of Swiss Patent No. 658 801 propose to dispose an electric motor with vertical axis below the gearing in the case of a roller bowl mill. In FIGS. 3 and 4 of Swiss Patent No. 658 801 the roller bowl mill is held by means of a mount or pillars, wherein the mount and the pillars, respectively, are supported on a foundation. In these cases, the electric motor was sunk into the foundation, so that constructional height can be saved above the foundation. In FIG. 2 of Swiss Patent No. 658 801 the roller bowl mill is held by means of pillars supported on a foundation. In this case the electric motor is disposed between the pillars and separately supported on the foundation between the pillars.

SUMMARY OF THE INVENTION

In the case of roller bowl mills and their respective drive arrangements known from the prior art, the motor is always a separate part. The inventor has found out that this has disadvantageous consequences for the design of the mill. In particular, this design requires the large vertical forces occurring during the milling process to be transferred laterally around the motor in the mill structure and the motor to be separately supported on a foundation.

It is an object of the present invention to provide a heavy-duty drive arrangement of the initially mentioned type which does not exhibit the disadvantages mentioned above. In particular, a drive arrangement with an alternative design is to be provided. Another object of the invention is to provide a corresponding mill.

Another object of the invention is to provide a drive arrangement which is free of bevel gear steps.

Another object of the invention is to provide a possibility of replacing bevel gear steps in already existing drive arrangements or mills, wherein it is achieved, in particular, that the space requirement is not increased or that it is even reduced.

Another object of the invention is to provide especially compact drive arrangements and mills.

Another object of the invention is to provide drive arrangements and mills, respectively, having a particularly long service life and/or very few maintenance requirements.

At least one of these objects is achieved by a device and a method comprising the features of the independent claims.

The heavy-duty drive arrangement for a mill having a grinding bowl rotatable about the vertical axis comprises: a housing, an electric motor and a gearing arrangement disposed in the housing and supported on the housing. The grinding bowl can be driven by means of the electric motor via the gearing arrangement. The electric motor is disposed below the gearing arrangement. The heavy-duty drive arrangement is characterized in that the electric motor is integrated in the housing. By integrating the electric motor, a drive arrangement with an alternative design can be provided.

To be more precise, the heavy-duty drive arrangement for a mill is generally a heavy-duty drive arrangement for the grinding bowl of a mill.

In one embodiment of the invention, the electric motor is disposed within the housing.

In one embodiment of the invention, the mill is a roller bowl mill.

In one embodiment of the invention, the electric motor is supported on the housing. In this way, it is not required any more to separately support the electric motor on a foundation; instead, only the housing needs to be supported on a foundation, wherein the gearing arrangement as well as the electric motor are supported on the housing. The overall stability of the mill can be increased thereby.

In one embodiment of the invention, the housing has a bottom element, and the electric motor is supported on the bottom element.

Typically, the bottom element is supported on a foundation.

In one embodiment of the invention, the bottom element comprises a bottom plate; in particular, the bottom element is a bottom plate.

In one embodiment of the invention, the electric motor is disposed in a motor housing disposed within the housing of the heavy-duty drive arrangement.

In one embodiment, the electric motor is additionally housed separately.

In one embodiment, the electric motor has a rotor axis oriented vertically.

In one embodiment of the invention, the electric motor has a rotor connected via a coupling to a gear of the gearing arrangement.

In one embodiment of the invention, the rotor is connected via a single coupling to a gear of the gearing arrangement.

In one embodiment of the invention, the gearing arrangement has a planetary gearing comprising a sun gear, and the sun gear is connected to the rotor via the coupling.

In one embodiment of the invention, the coupling has a toothing formed in the rotor. Thereby an especially compact configuration of the heavy-duty drive arrangement can be realized.

In one embodiment of the invention, the gear of the gearing arrangement has an extension towards the electric motor, the end of which has a toothing and engages in a toothing formed in the rotor.

In one embodiment of the invention, the coupling includes these two toothings, i.e. the toothing of the end of the extension of the gear towards the electric motor and the toothing formed in the rotor.

In one embodiment of the invention, the gear of the gearing arrangement (especially the sun gear of a planetary gearing) has an extension (shaft) towards the electric motor, the end of which has an outer toothing forming the coupling, or at least a part thereof, together with an inner toothing formed in the rotor.

In one embodiment of the invention, the coupling is disposed within the rotor. This enables a low constructional height of the drive arrangement.

In one embodiment of the invention, the coupling is completely disposed within the rotor. This enables an especially low constructional height of the drive arrangement.

In one embodiment of the invention, the rotor has an uppermost bearing (i.e. a bearing for the rotation of the rotor, which bearing is disposed in the uppermost position in the vertical direction), and the coupling is (partly or completely) disposed below the upper end of the uppermost bearing or even below the uppermost bearing. Typically, the rotor has a lowermost bearing and an uppermost bearing.

This embodiment is especially advantageous in case the rotor is embodied as an inner rotor (concerning the inner rotor, see further down below).

In one embodiment of the invention, the coupling is a rigid coupling, more precisely: a rotationally rigid coupling.

In one embodiment of the invention, the coupling is a flexible coupling, more precisely: a rotationally flexible coupling. In particular, the coupling can be a highly flexible coupling. The term "highly flexible coupling" designates such flexible couplings which are designed or intended to be flexibly deformed (twisted) by several degrees.

In one embodiment of the invention, the coupling is directly integrated in the rotor.

In one embodiment of the invention, the electric motor has a rotor connected without a coupling to a gear of the gearing arrangement.

In one embodiment of the invention, the gearing arrangement has a planetary gearing comprising a sun gear, and the sun gear is connected without a coupling to the rotor.

In one embodiment of the invention, the gearing arrangement and the electric motor are directly connected to one another.

In one embodiment, the gearing arrangement and the rotor are connected to one another via a torsional shaft. A torsional shaft is designed such that it admits a certain amount of torsion. By providing a torsional shaft, suddenly occurring forces can be compensated, such as forces by impacts incurred by the grinding of thick stones and leading to deceleration of the roller bowl mill.

In one embodiment of the invention, the housing has a partial housing accommodating the electric motor, as well as another partial housing accommodating the gearing arrangement.

In one embodiment of the invention, the gearing arrangement is supported on the partial housing of the electric motor.

In one embodiment of the invention, at least a part of at least a bearing of the rotor is disposed with respect to a vertical coordinate within the extension range of the active range of the rotor. This results in a low constructional height of the electric motor.

In one embodiment of the invention, the rotor has a diameter which is larger than the vertical extension of the active part of the rotor. This enables a low constructional height of the electric motor.

In one embodiment of the invention, the rotor is an inner rotor, which means that the stator is disposed with respect to a radial coordinate outside of the active part of the rotor.

In one embodiment of the invention, the rotor is an outer rotor, which means that the stator is disposed with respect to a radial coordinate within the active part of the rotor.

In one embodiment of the invention, the rotor is a disk rotor, which means that the rotor and the stator overlap with respect to a radial coordinate, and the magnetic flux at least partly runs substantially in the vertical direction.

In one embodiment of the invention, the rotor is slidably supported.

In one embodiment of the invention, the rotor is supported by means of roller bearings, in particular by means of swivel-joint roller bearings.

In one embodiment of the invention, the electric motor has a stator including one or (advantageously) several pole shoes which can be mounted individually.

In one embodiment of the invention, the rotor has permanent magnets, especially those including at least one element of the rare earths. This enables an especially compact configuration of the electric motor.

In one embodiment of the invention, the electric motor has at least two poles.

In one embodiment of the invention, the rotor has at least one torsional vibration damping element. Thereby the safety factor of the gearing can be designed to be smaller.

In one embodiment of the invention, the electric motor is cooled, especially air-cooled, by means of a fan, wherein in one embodiment the electric motor is cooled directly (itself) by means of a fan and in another embodiment, yet combinable thereto, the electric motor is cooled indirectly by cooling a housing accommodating the electric motor by means of the fan.

In one embodiment of the invention, the electric motor is cooled indirectly by cooling a housing accommodating the electric motor by a liquid coolant.

In one embodiment of the invention, the gearing arrangement has a cooling system and the electric motor has a cooling system thermally connected thereto. Thereby the over-all cooling system can be designed in a simpler way. For example, identical coolants can be used for cooling the gearing arrangement as well as the electric motor; in particular, this coolant can additionally serve as a lubricant for the gearing arrangement.

In one embodiment of the invention, the electric motor has a cooling system including a fluid (i.e. liquid or gaseous) coolant in a closed circuit, wherein the coolant can give off heat to another fluid coolant by means of a heat exchanger. Thereby the electric motor can be cooled in an especially efficient way.

In one embodiment of the invention, the gearing arrangement has a spur gear arrangement. This can be especially advantageous in the case of an eccentrically arranged electric motor, i.e. an electric motor having a rotor axis which does not coincide with the rotational axis of the grinding bowl.

In one embodiment of the invention, the gearing arrangement has a planetary gearing.

In one embodiment of the invention, the planetary gearing has a vertically extending central axis.

In one embodiment of the invention, the planetary gearing has a central axis which corresponds to the rotor axis of the grinding bowl.

In one embodiment of the invention, the planetary gearing has a central axis which corresponds to the rotor axis of the electric motor.

In one embodiment of the invention, the gearing arrangement has a multi-stage, especially a two-stage planetary gearing. The planetary gearings can be coupled with or without power distribution.

In one embodiment, the electric motor is disposed in the same housing as other parts of the heavy-duty drive arrangement, such as especially the gearing arrangement.

The mill according to the invention has a heavy-duty drive arrangement according to the invention. In one embodiment, the mill is a roller bowl mill, for example, a cement mill or a coal mill.

Further embodiments and advantages can be gathered from the dependent claims and the figures.

BRIEF DESCRIPTION OF THE DRAWINGS

Hereinafter the subject-matter of the invention is explained in greater detail by way of exemplary embodiments and the accompanying drawings, wherein FIG. 1 schematically shows a sectional view of a drive arrangement having an inner-rotor electric motor connected directly to a one-stage planetary gearing.

Figure 1:
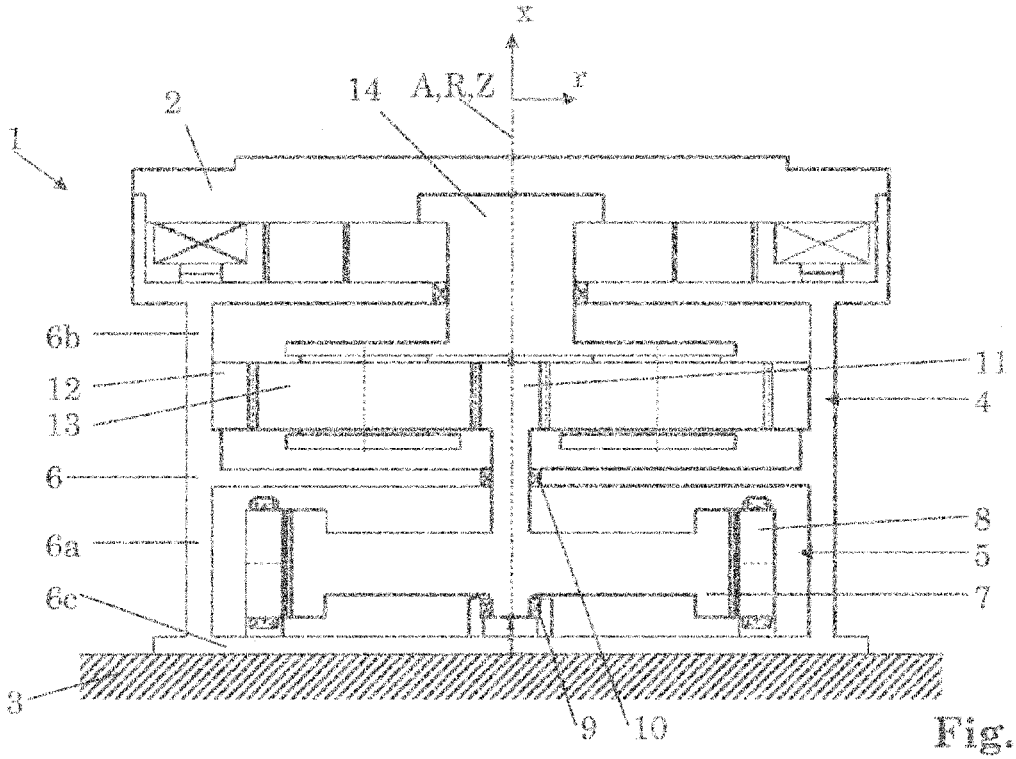

The reference numerals used in the drawings and their designations are summarized in the List of Reference Numerals. Some of the parts which are not substantial for understanding the invention are not represented. The exemplary embodiments exemplify the subject-matter of the invention and do not have any restricting effect.

DETAILED DESCRIPTION OF PRESENT PREFERRED EMBODIMENTS

FIG. 1 schematically shows a sectional view of a drive arrangement 1 having an inner-rotor electric motor 5 connected directly to a one-stage planetary gearing 4. As in the other figures, too, toothings are not explicitly shown in FIG. 1.

The drive arrangement 1 has a housing 6, in which the electric motor 5 and the planetary gearing 4 are supported. The electric motor 5 has a stator 8 and a rotor 7. The rotor 7 is supported in a rotatable manner in an upper bearing 10 and a lower bearing 9. The stator 8 as well as the lower bearing 9 are supported on a bottom element 6*c* of the housing, which is supported on a foundation 3.

The electric motor 5 is disposed in a lower partial housing 6*a* of the housing 6, while the planetary gearing 4 is disposed in an upper partial housing 6*b* of the housing 6. Thereby the planetary gearing 4 is supported on the lower partial housing 6*a*.

The planetary gearing 4 has an internal gear 12, a sun gear 11 as well as several planet gears 13. The sun gear 11 is directly connected to the rotor 7 of the electric motor 5; no coupling is provided between these two. Thus, the electric motor 5 (more precisely: rotor 7) and the planetary gearing 4 (more precisely: sun gear 11) are connected such that they are fixed to one another in a play-free manner. The rotation of the rotor 7 thus causes an immediate rotation of the sun gear 11, by which the planet gears 13 are driven, which in turn drive an output flange 14 of the drive arrangement 1. The rotation of the output flange 14 drives a mill flange 2 associated with a cement mill.

The electric motor 5 has a rotor axis R coinciding with a central axis Z of the planetary gearing 4 and a rotational axis A of the mill flange 2. The axes A, Z, R all extend along the vertical. A vertical coordinate is designated as x, a radial coordinate as r.

Figure 2:
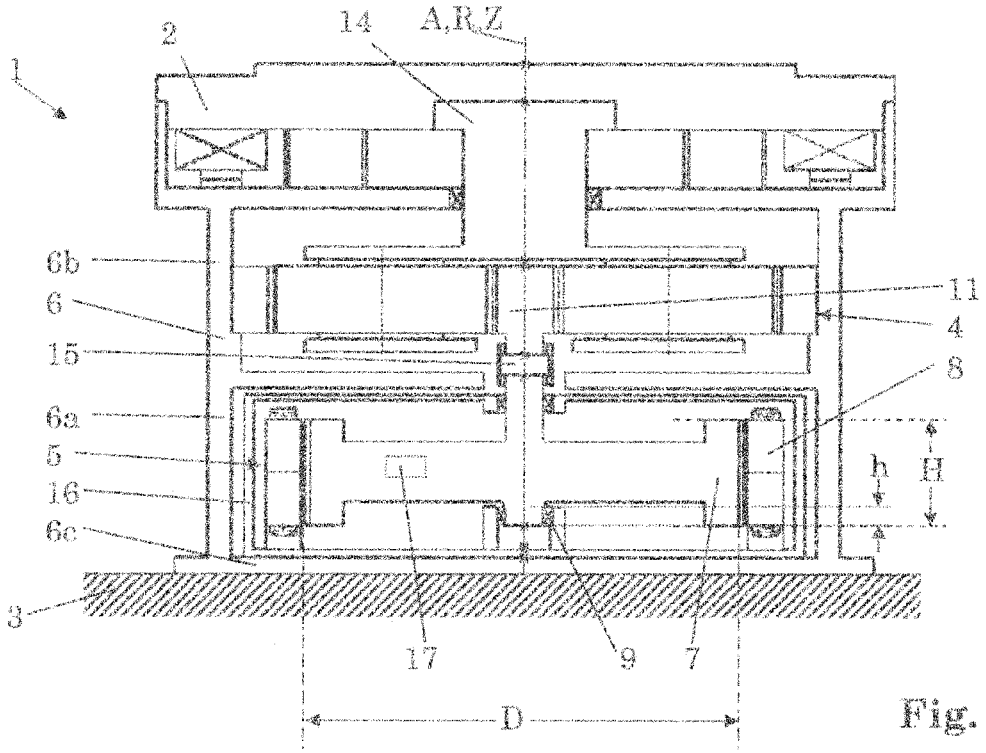
FIG. 2 schematically shows a sectional view of a drive arrangement having a separately housed inner-rotor electric motor connected to a one-stage planetary gearing via a coupling.

FIG. 2 schematically shows a sectional view of a drive arrangement 1 having a separately housed inner-rotor electric motor 5 connected to a one-stage planetary gearing 4 via a coupling 15.

The embodiment of FIG. 2 largely corresponds to the embodiment shown in FIG. 1 and will be described on the basis thereof. In FIG. 2 the electric motor 5 is not only disposed within the housing 6, but also separately housed in a separate housing 16 (motor housing 16) of lightweight construction. Further, the sun gear 11 is connected to the electric motor 5 not directly, but via a coupling 15, for example, via a flexible coupling.

As can be seen from FIG. 2, the lower bearing 9 of the rotor 7 (having an axial extension h) is disposed completely within the axial extension (height) H of the active part of the rotor 7. Further, the height H of the active part of the rotor 7 is smaller than the diameter D of the rotor 7.

Reference numeral 17 in FIG. 2 designates a torsional vibration damping element, which is only schematically shown. It effects damping of torsional vibrations in the rotor. This may be realized, for example, by means of a mass body supported by a damping element (for example, a spring element) or by means of a damping medium (for example, a liquid).

Figure 3:
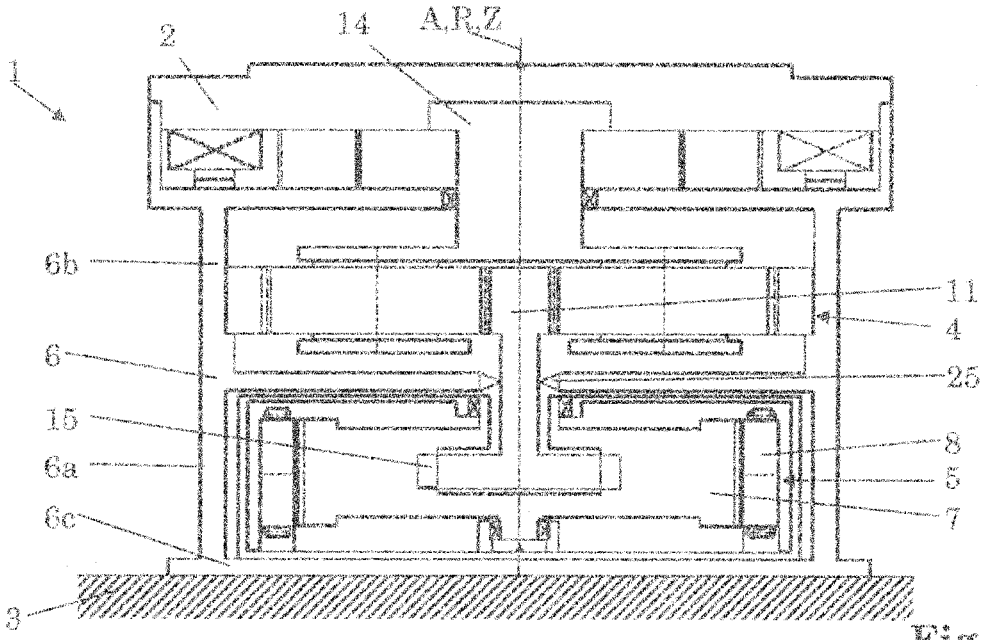
FIG. 3 schematically shows a sectional view of a drive arrangement having a separately housed inner-rotor electric motor connected to a one-stage planetary gearing via a coupling integrated in the rotor.

FIG. 3 schematically shows a sectional view of a drive arrangement having a separately housed inner-rotor electric motor 5 connected to a one-stage planetary gearing via a coupling 15 integrated in the rotor.

The embodiment of FIG. 3 largely corresponds to the embodiment shown in FIG. 2 and will be described on the basis thereof. In FIG. 3, a flexible coupling 15 is disposed within the rotor 7. It is formed by the cooperation of two toothings, one of which is formed in the rotor 7 and the other one at an end of an extension of the gear 11 of the planetary gearing 4, wherein flexible bodies are disposed between the teeth, so that a desired flexibility is achieved. Reference numeral 25 designates a seal which seals the lower partial housing 6*a* accommodating the electric motor 5 against the upper partial housing 6*b* accommodating the gearing arrangement 4.

Figure 4:
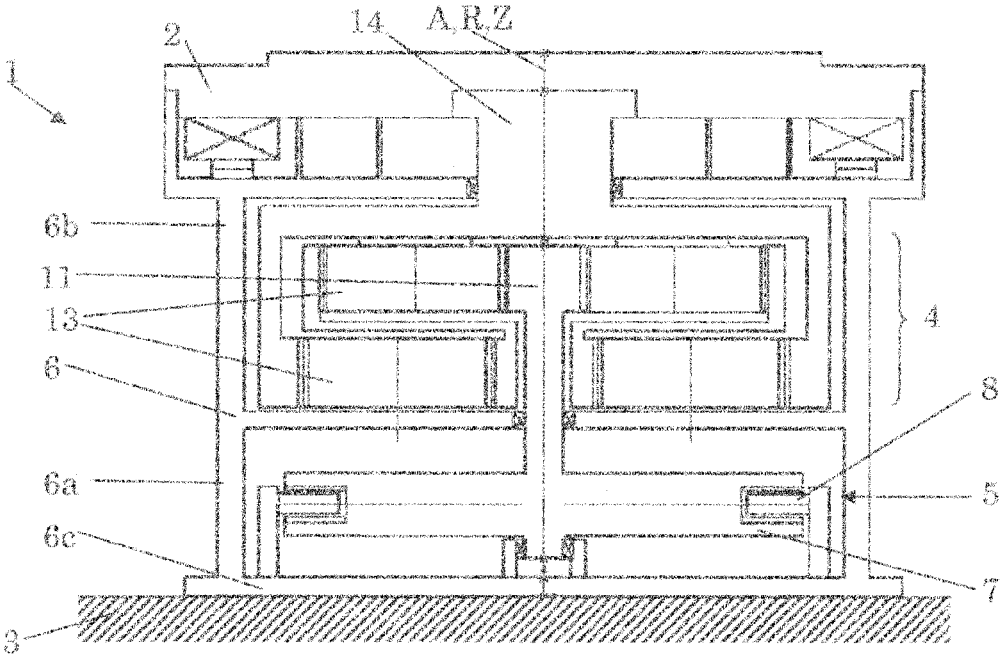
FIG. 4 schematically shows a sectional view of a drive arrangement having a disk-rotor electric motor connected directly to a multi-stage planetary gearing.

The embodiment of FIG. 4 largely corresponds to the embodiment shown in FIG. 1 and will be described on the basis thereof. FIG. 4 schematically shows a sectional view of a drive arrangement 1 having a disk-rotor electric motor 5 connected directly to a multistage planetary gearing 4 with power distribution. The sun gear 11 of the upper partial gearing is connected directly to the rotor 7.

Figure 5:
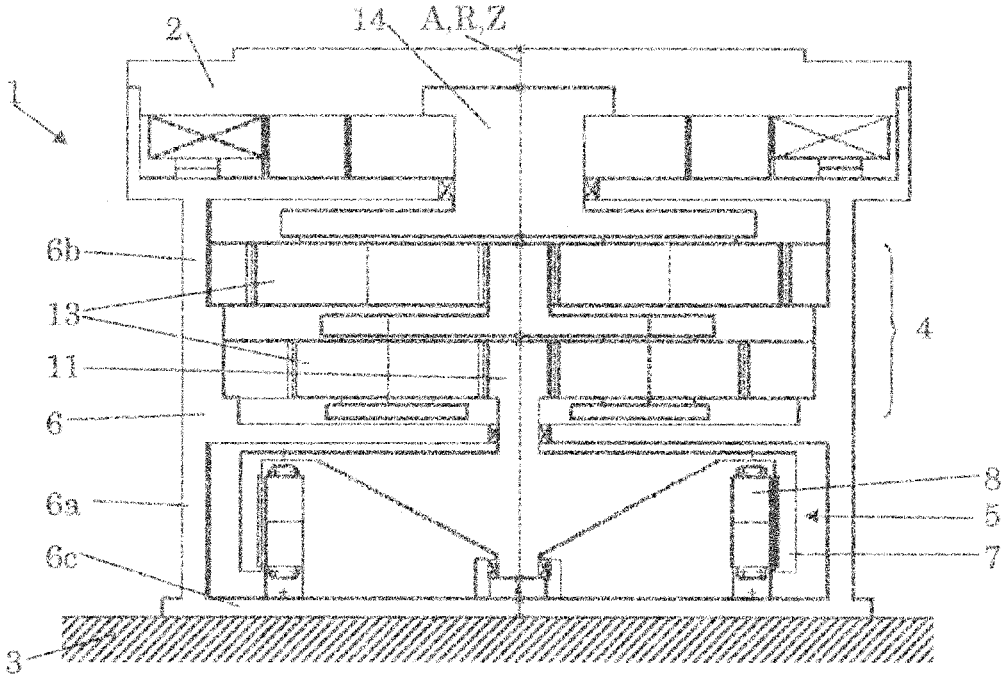
FIG. 5 schematically shows a sectional view of a drive arrangement having an outer-rotor electric motor connected directly to a multi-stage planetary gearing.

The embodiment of FIG. 5 largely corresponds to the embodiments shown in FIGS. 1 and 4 and will be described on the basis thereof. FIG. 5 schematically shows a sectional view of a drive arrangement 1 having an outer-rotor electric motor 5 connected directly to a multi-stage planetary gearing 4. The sun gear 11 of the lower partial gearing is connected directly to the rotor 7.

Figure 6:
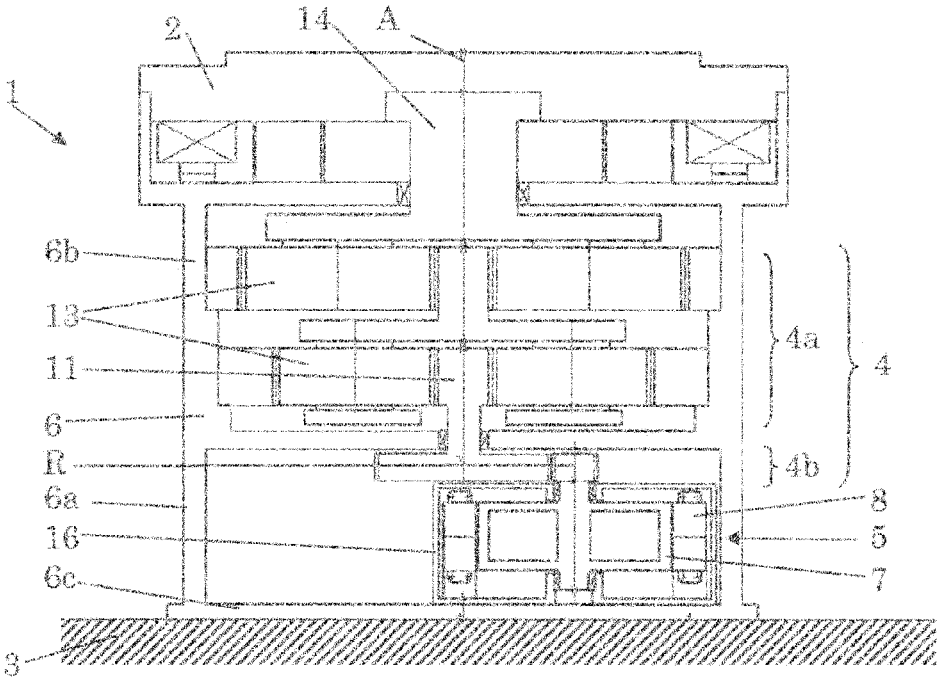
FIG. 6 schematically shows a sectional view of a drive arrangement having an eccentrically arranged outer-rotor electric motor and a spur gear arrangement.

The embodiment of FIG. 6 largely corresponds to the embodiment shown in FIG. 5 and will be described on the basis thereof. FIG. 6 schematically shows a sectional view of a drive arrangement 1 having an eccentrically arranged outer-rotor electric motor 5 and a spur gear arrangement 4*b*. The spur gear arrangement 4*b*, together with a planetary gearing arrangement 4*a* consisting of two planetary gearings, forms the gearing arrangement 4 of the drive arrangement 1. The electric motor 5 has a rotor axis R extending in parallel with the axis A, but not coinciding therewith. The rotation of the rotor 7 is transmitted through the spur gear arrangement 4*b* to the planetary gearing arrangement 4*b*. The electric motor is separately housed (motor housing 16) and has a hollow rotor 7.

The exemplary embodiments shown in FIGS. 1 to 6 constitute only a few variants which are possible within the scope of the invention. In particular, it is to be noted that the combinations of electric motors 5 and gearing assemblies 4 discussed in connection with the exemplary embodiments shown in FIGS. 1 to 6 are only exemplary and that the discussed electric motors 5 can be at will combined with the discussed gearing arrangements 4 for forming a drive arrangement 1. Further, any combinations thereof are possible with the cooling systems discussed in the following.

Figure 7:
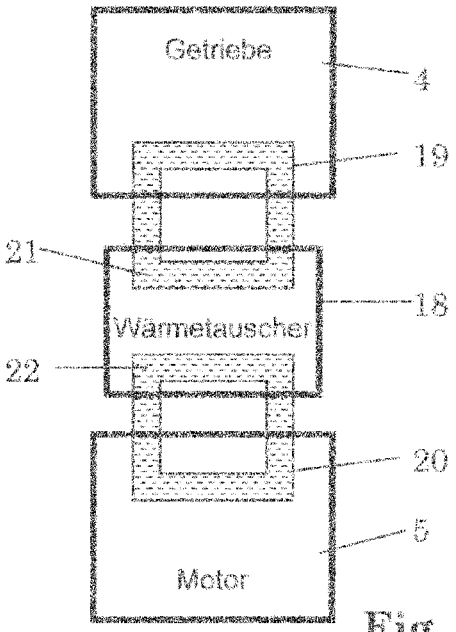
FIG. 7 schematically shows a diagram of cooling systems of a drive arrangement.

FIG. 7 very schematically shows a diagram of cooling systems of a drive arrangement, for example, one corresponding to those described above. The electric motor 5 has a closed cooling circuit 20 filled with a cooling fluid 22, for example, water or a gas. Further, the gearing arrangement 4 (for example, a planetary gearing 4) has a closed cooling circuit 19 filled with a cooling fluid 21. The two cooling circuits 19, 20 are thermally coupled, for example, via a heat exchanger 18.

Figure 8:
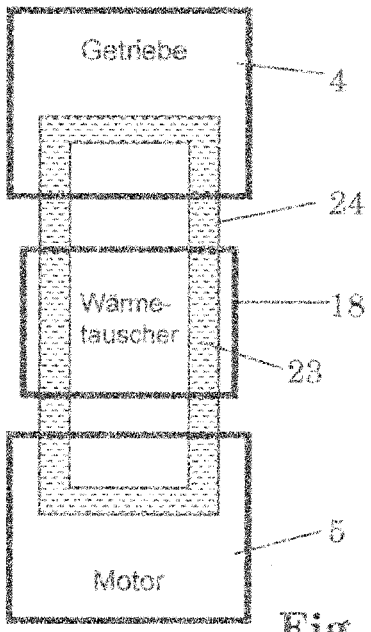
FIG. 8 schematically shows a diagram of a cooling system of a drive arrangement.

FIG. 8, in the same manner as FIG. 7, very schematically shows a diagram of a cooling system of a drive arrangement, for example, one corresponding to those described above. In this case, the cooling circuit of the gearing arrangement 4 and the cooling circuit of the electric motor 5 form a common cooling circuit 24. Thus, identical cooling fluids 23 are used for cooling the gearing arrangement 4 as well as the electric motor 5.

In the exemplary embodiment according to FIG. 7 as well as in the exemplary embodiment according to FIG. 8, the cooling fluid 21 and 23, respectively, used for cooling the gearing arrangement 4 also serves as lubricant for the gearing arrangement 4.

While certain present preferred embodiments of the mill, drive arrangement, and methods of practicing the same have been shown and described, it is to be distinctly understood that the invention is not limited thereto but may be otherwise variously embodied and practiced within the scope of the following claims.

LIST OF REFERENCE NUMERALS

1 drive arrangement, heavy-duty drive arrangement
2 mill flange
3 foundation
4 gearing arrangement
4*a* planetary gearing arrangement
4*b* spur gear arrangement
5 electric motor
6 housing
6*a* lower partial housing
6*b* upper partial housing
6*c* bottom element, bottom plate element
7 rotor
8 stator
9 bearing
10 bearing
11 sun gear
12 internal gear
13 planet gear
14 output flange
15 coupling
16 motor housing
17 torsional vibration damping element
18 heat exchanger
19 cooling circuit
20 cooling circuit
21 cooling fluid
22 cooling fluid
23 cooling fluid
24 cooling circuit
25 seal
A axis, vertical
D diameter
h height, vertical extension
H height, vertical extension
r radial coordinate
R axis, rotor axis
x axial coordinate, vertical coordinate

The invention claimed is:

1. A drive arrangement for a mill having a grinding bowl rotatable about a vertical axis, the drive arrangement comprising:

a housing;

an electric motor disposed within the housing and supported on a portion of the housing and being integrated in the housing; and a gearing arrangement disposed in the housing and supported on a portion of the housing; and wherein the grinding bowl is driven by the electric motor via the gearing arrangement; and wherein the electric motor is disposed below the gearing arrangement.

2. The drive arrangement of claim 1, wherein the gearing arrangement comprises a one stage planetary gearing or a spur gear arrangement.

3. The drive arrangement of claim 1 wherein the housing has a bottom element that is supported on a foundation and the electric motor is supported on the bottom element of the housing.

4. The drive arrangement of claim 1 wherein the electric motor is in a motor housing, the motor housing being within the housing of the drive arrangement.

5. The drive arrangement of claim 1 wherein the electric motor has a rotor connective to a gear of the gearing arrangement via a coupling.

6. The drive arrangement of claim 5 wherein the coupling has a toothing formed in the rotor.

7. The drive arrangement of claim 5 wherein the coupling is disposed within the rotor.

8. The drive arrangement of claim 7 wherein the coupling is a flexible coupling.

9. The drive arrangement of claim 1 wherein the electric motor has a rotor connective to a gear of the gearing arrangement, the gear of the gearing arrangement has an extension that extends toward the electric motor, an end of the extension has a toothing that engages a toothing formed in the rotor.

10. The drive arrangement of claim 1 wherein the electric motor has a rotor connected to a gear of the gearing arrangement without a coupling or is directly connected to the gear of the gearing arrangement.

11. The drive arrangement of claim 1 wherein the housing has a first portion that is sized to accommodate the electric motor and has a second portion above the first portion that is sized to accommodate the gearing arrangement.

12. The drive arrangement of claim 11 wherein the gearing arrangement is supported on the first portion of the housing.

13. The drive arrangement of claim 1 wherein the electric motor has a rotor and wherein at least a part of at least one bearing of the rotor is disposed with respect to a vertical coordinate within an extension range of an active range of the rotor.

14. The drive arrangement of claim 1 wherein the electric motor has a rotor and the rotor has a diameter that is larger than a vertical extension of an active part of the rotor.

15. The drive arrangement of claim 1 wherein the gearing arrangement is comprised of a cooling system and wherein the electric motor has a cooling system that is thermally connected to the cooling system of the gearing arrangement.

16. The drive arrangement of claim 15 wherein the cooling system of the electric motor has a fluid coolant in a closed circuit, the fluid coolant exchanging heat with another fluid coolant via a heat exchanger.

17. The drive arrangement of claim 1 wherein the gearing arrangement is comprised of a multi-stage planetary gearing.

18. A mill comprising:

a grinding bowl rotatable about a vertical axis;

a drive arrangement for rotating the grinding bowl about the vertical axis, the drive arrangement comprising:

a housing, an electric motor disposed in the housing and supported on a portion of the housing and is integrated in the housing, and a gear arrangement disposed in the housing and supported on a portion of the housing; and wherein the grinding bowl is driven by the electric motor via the gear arrangement; and wherein the electric motor is disposed below the gear arrangement.

19. The mill of claim 18 wherein the electric motor is comprised of a rotor and the gear arrangement is comprised of a spur gear arrangement connected to a planetary gear arrangement, the spur gear arrangement being connected to the rotor and wherein at least one gear of the planetary gear arrangement is rotatable for rotating the grinding bowl.

20. The mill of claim 18 wherein the electric motor is comprised of a rotor and a torsional shaft connects the gear arrangement to the rotor of the electric motor and wherein the gear arrangement does not have any bevel gear steps.

* * * * *